US012390020B2

(12) United States Patent
Sells

(10) Patent No.: US 12,390,020 B2
(45) Date of Patent: Aug. 19, 2025

(54) BREASTFEEDING PILLOW

(71) Applicant: Sells Baby Products LLC, Reno, NV (US)

(72) Inventor: Carla Sells, Reno, NV (US)

(73) Assignee: Sells Baby Products LLC, Reno, NV (US)

( * ) Notice: Subject to any disclaimer, the term of this patent is extended or adjusted under 35 U.S.C. 154(b) by 0 days.

(21) Appl. No.: 18/945,179

(22) Filed: Nov. 12, 2024

(65) Prior Publication Data

US 2025/0151927 A1 May 15, 2025

Related U.S. Application Data

(60) Provisional application No. 63/598,812, filed on Nov. 14, 2023.

(51) Int. Cl.
*A47D 13/08* (2006.01)
*A47D 13/00* (2006.01)

(52) U.S. Cl.
CPC ..... *A47D 13/083* (2013.01); *A47D 13/08* (2013.01)

(58) Field of Classification Search
CPC ..... A47D 13/083; A47D 13/08
USPC ..... 5/655, 652
See application file for complete search history.

(56) References Cited

U.S. PATENT DOCUMENTS 4,802,244 A * 2/1989 McGrath-Saleh ..... A47D 13/08 2/69.5
5,029,351 A * 7/1991 Weber ..... A47D 13/083 5/655
5,109,557 A 5/1992 Koy
5,392,785 A * 2/1995 Donahue ..... A47D 15/003 5/655
5,455,973 A * 10/1995 Brumfield ..... A47D 15/003 5/655
5,800,368 A * 9/1998 Klingemann ..... A47D 13/08 128/845
D416,159 S * 11/1999 Porter ..... D6/333
6,499,164 B1 12/2002 Leach
6,564,408 B2 * 5/2003 Van Vuuren ..... A47D 5/00 5/655
6,651,282 B1 11/2003 Skoug
(Continued)

FOREIGN PATENT DOCUMENTS

CN 2453777 Y 10/2001
CN 206880496 1/2018
(Continued)

OTHER PUBLICATIONS https://www.boppy.com/collections/nursing-pillows/products/boppy-anywhere-nursing-pillow?variant=40094161567810.
(Continued)

*Primary Examiner* — Robert G Santos
(74) *Attorney, Agent, or Firm* — Gallium Law; Wesley Schwie; Isabel Fox

(57) ABSTRACT

The disclosure includes a breastfeeding pillow comprising a head portion configured to support a head of a baby, a tail portion located opposite the head portion and configured to support at least one leg of the baby, a middle portion located between the head portion and the tail portion, the middle portion configured to support a torso of the baby, and a foot support extending from an end of the tail portion, the foot support configured to receive at least one foot of the baby.

20 Claims, 15 Drawing Sheets

(56) References Cited

U.S. PATENT DOCUMENTS

| | | | | |
|---|---|---|---|---|
| 6,922,861 | B1 * | 8/2005 | Mathis | A47D 15/008 5/915 |
| 7,111,347 | B1 * | 9/2006 | Cottrell | A47D 13/083 5/655 |
| 7,322,061 | B2 * | 1/2008 | Carroll | A47D 13/083 5/640 |
| 7,587,773 | B2 | 9/2009 | Littlehorn | |
| 7,886,381 | B2 | 2/2011 | Aiken | |
| 8,166,587 | B2 | 5/2012 | Collins | |
| 8,205,285 | B1 * | 6/2012 | Klingemann | A47D 13/08 5/655 |
| 8,418,295 | B2 * | 4/2013 | Clark | A47D 13/083 5/655 |
| 8,516,638 | B2 | 8/2013 | Kummerfeld | |
| 9,265,357 | B2 | 2/2016 | Fang | |
| 11,871,854 | B2 * | 1/2024 | Barbalinardo | A47D 13/083 |
| 2002/0023301 | A1 * | 2/2002 | Vuuren | A47D 5/00 5/655 |
| 2006/0101579 | A1 * | 5/2006 | Albers | A47D 13/083 5/655 |
| 2007/0209115 | A1 * | 9/2007 | Carroll | A47C 20/027 5/636 |
| 2011/0119833 | A1 * | 5/2011 | Clark | A47D 13/083 5/655 |
| 2014/0359947 | A1 * | 12/2014 | Turner | A47D 13/083 5/655 |
| 2016/0235216 | A1 | 8/2016 | Einhorn | |
| 2017/0181478 | A1 | 6/2017 | O'Donnell | |
| 2021/0235885 | A1 | 8/2021 | Gibbons | |
| 2023/0389719 | A1 * | 12/2023 | Barbalinardo | A47G 9/10 |

FOREIGN PATENT DOCUMENTS

| | | | |
|---|---|---|---|
| JP | 2012-011191 | A | 1/2012 |
| JP | 6061168 | B2 | 2/2018 |
| KR | 20100003188 | U | 3/2010 |
| KR | 10-1438928 | B1 | 9/2014 |
| KR | 20210058458 | A | 5/2021 |

OTHER PUBLICATIONS https://dockatol.com/products/nursing-pillow-igvalx:litec.
https://nuangel.com/collections/trinity%E2%84%A2-nursing-pillows.
https://stores.blessednest.com/the-nesting-pillow/.
https://www.amazon.sa/-/en/PAMYO-Positionery-Breastfeeding-Detachable-Surround/dp/808C7CPTCH.
International Search Report and Written Opinion dated Feb. 28, 2025 issued in corresponding application No. PCT/US2024/055784.

* cited by examiner

BREASTFEEDING PILLOW

CROSS-REFERENCE TO RELATED APPLICATIONS

The present application claims priority to U.S. Provisional Patent Application No. 63/598,812 filed on Nov. 14, 2023, entitled "Breastfeeding Pillow" the entire disclosure of which is incorporated by reference herein.

TECHNICAL FIELD

The present disclosure relates to the field of pillows and cushions designed for nursing, or breastfeeding, an infant.

BACKGROUND OF THE INVENTION

Breastfeeding pillows are specially designed cushions used by nursing mothers to provide support and comfort during breastfeeding or bottle-feeding sessions. The primary purpose is to help both the mother and the baby maintain a comfortable and ergonomic feeding position. Breastfeeding pillows can be in a "C" shape designed to curve around both sides of the abdomen of the mother and provide a surface on which to place the baby during feeding.

SUMMARY OF THE INVENTION

The disclosure includes a breastfeeding pillow including a head portion configured to support a head of a baby, a tail portion located opposite the head portion and configured to support at least one leg of the baby, and a middle portion located between the head portion and the tail portion, the middle portion configured to support a torso of the baby. In some embodiments, the breastfeeding pillow further comprises a foot support extending from an end of the tail portion, wherein the foot support is configured to receive at least one foot of the baby. The foot support may be configured to extend substantially perpendicular to the tail portion and may be configured to at least partially surround the end of the tail portion. In some embodiments, the foot support is configured to provide a surface for the at least one foot of the baby to press against, thereby providing pressure against the at least one foot of the baby.

The breastfeeding pillow may comprise a first side configured to align the baby with a first breast of a nursing mother and a second side configured to align the baby with a second breast of the nursing mother. In some embodiments, the foot support is configured to move between a first position and a second position, wherein in the first position, the foot support extends substantially perpendicular from the first side, and in the second position, the foot support extends substantially perpendicular from the second side.

The foot support may be configured to move between a first position and a second position, wherein in the first position the foot support extends along a first direction from the tail portion, and in the second position the foot support extends along a second direction from the tail portion, wherein the second direction is substantially opposite the first direction. The first direction and the second direction may extend substantially perpendicular from the tail portion.

In some embodiments, the foot support comprises a first end coupled to the tail portion and a second end located opposite the first end. The first end of the foot support may be configured to wrap around the tail portion. In some embodiments, the first end of the foot support wraps around the tail portion in an uneven manner such that the first end of the foot support extends further along an outer edge of the breastfeeding pillow than an inner edge of the breastfeeding pillow. The foot support may also include a stretchable member located between the first end and the second end, and the stretchable member may be configured to maintain a curved shape of the foot support.

The middle portion of the breastfeeding pillow may define a curved shape configured to fit around an abdomen of a nursing mother. In some embodiments, the curved shape reduces an amount of space between the baby and the nursing mother to thereby facilitate physical contact between the baby and the nursing mother. The head portion, the tail portion, and the middle portion may define an apostrophe shape.

In some embodiments, the head portion defines a first height and the tail portion defines a second height that is less than the first height, thereby configuring the breastfeeding pillow to elevate the head of the baby above the at least one leg of the baby. The middle portion may define a third height that is less than the first height and greater than the second height such that the breastfeeding pillow slopes downward from the head portion to the tail portion. In some embodiments, the first height is at least nine inches, the second height is at least three inches, and the third height is at least seven inches.

The foot support may define a height of about five inches and a length of about twelve inches. In some embodiments, the breastfeeding pillow defines an overall length of about twenty inches. The breastfeeding pillow may be sized and configured for use in feeding newborns and infants up to about six months of age.

In some embodiments, the breastfeeding pillow includes a removable slipcover configured to receive and retain each of the head portion, the middle portion, and at least a portion of the tail portion.

The foregoing, and other features and advantages of the invention, will be apparent from the following, more particular description of the preferred embodiments of the invention, the accompanying drawings, and the claims.

BRIEF DESCRIPTION OF THE DRAWINGS

These and other features, aspects, and advantages are described below with reference to the drawings, which are intended to illustrate, but not to limit, the invention. In the drawings, like characters denote corresponding features consistently throughout similar embodiments.

DETAILED DESCRIPTION OF THE INVENTION

Breastfeeding pillows are specially designed cushions used by nursing mothers to provide support and comfort during breastfeeding or bottle-feeding sessions. One of the key elements of a successful breastfeeding session is the latch maintained by the baby on the mother's nipple and areola-without a deep latch, it can be difficult for the baby to transfer milk, resulting in low milk supply and possible nipple damage, which can be frustrating for both the baby and the mother. To get a good latch, the baby must feel stable. There are three key pressure points on a baby's body that help the baby feel stable, thereby encouraging a strong latch: the hands, the abdomen, and the feet.

Traditional breastfeeding positions, with or without breastfeeding pillows, typically satisfy the pressure points in the hands and abdomen because the baby's hands are usually cupped around the mother's breast, and the baby's abdomen is usually pressed against the mother's torso. However, traditional feeding positions and typical breastfeeding pillows fail to provide pressure against the baby's feet, which can leave the baby feeling not fully supported or stable. For example, babies often kick their legs (or otherwise squirm) around while feeding, which can be an indication of some discomfort or instability.

In addition, traditional "C"-shaped breastfeeding pillows are designed to curve around the mother's abdomen but may not be suitable for mothers of all sizes. Often, a gap forms between the center of the pillow and the mother, and the baby can sink into this gap rather than remain in a highly supported position for feeding. An optimal breastfeeding position includes the baby lying about level with the mother's breast, but this level position can't be maintained when the baby sinks too far into a pillow or between the pillow and the mother.

In an effort to encourage stability and comfort while feeding, the breastfeeding pillow disclosed herein includes an angled surface for a feeding baby to lay on and a foot support element intended to provide the baby with a support to press their feet against.

Figure 1:
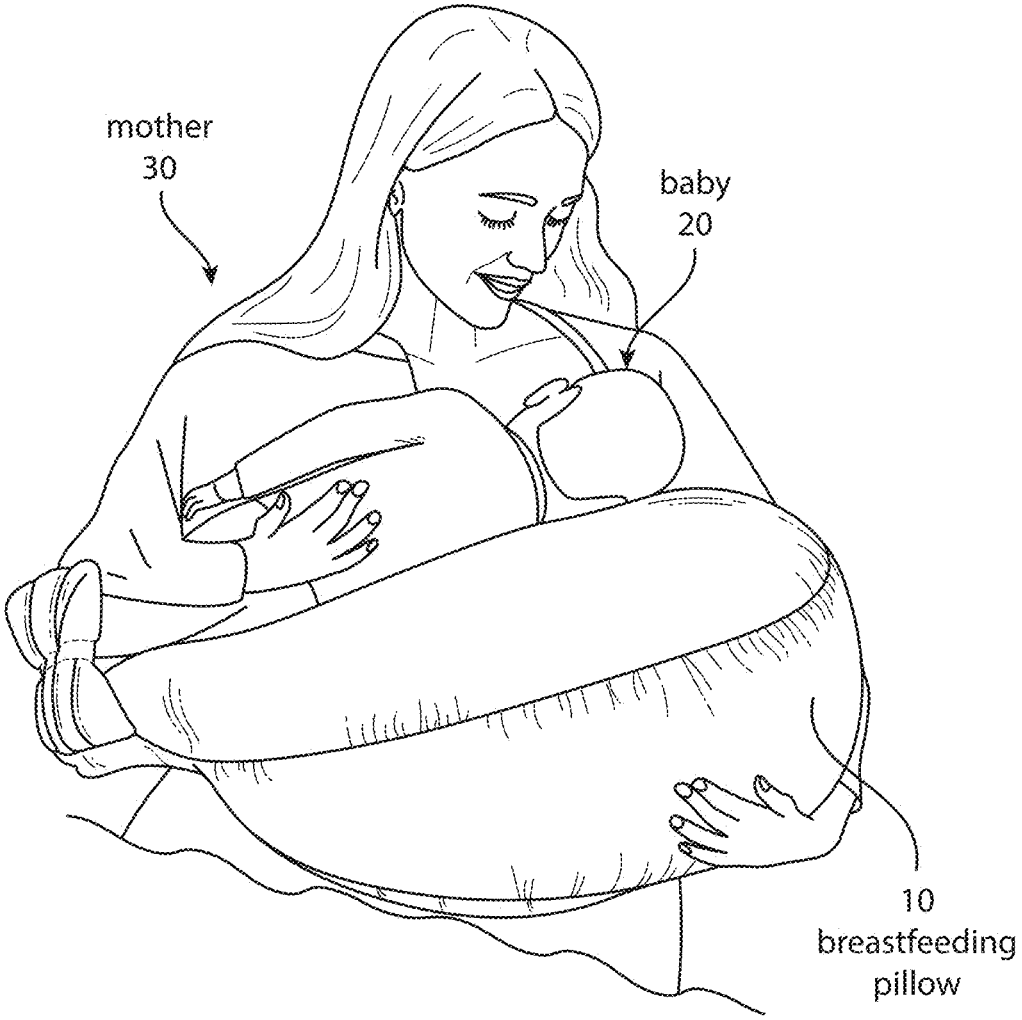
FIG. 1 illustrates a mother and a baby, with the baby lying on a breastfeeding pillow, according to some embodiments.

FIG. 1 illustrates a breastfeeding pillow 10 (hereafter, "the pillow 10") resting on the lap of a mother 30, with a baby 20 lying on the pillow 10. In some embodiments, the pillow 10 is arranged and configured to position the baby 20 such that the baby's head is elevated above the rest of the baby's 20 body, which may help facilitate swallowing while feeding. The pillow 10 may include multiple elements configured to stabilize and support the baby 20, as will be discussed throughout this disclosure. The baby 20 may rest directly on the pillow 10, as demonstrated in FIG. 1, or the mother 30 may hold the baby 20 while the mother's arm(s) rest on the pillow 10, thereby maintaining the sloped position for the baby 20.

Figure 2:
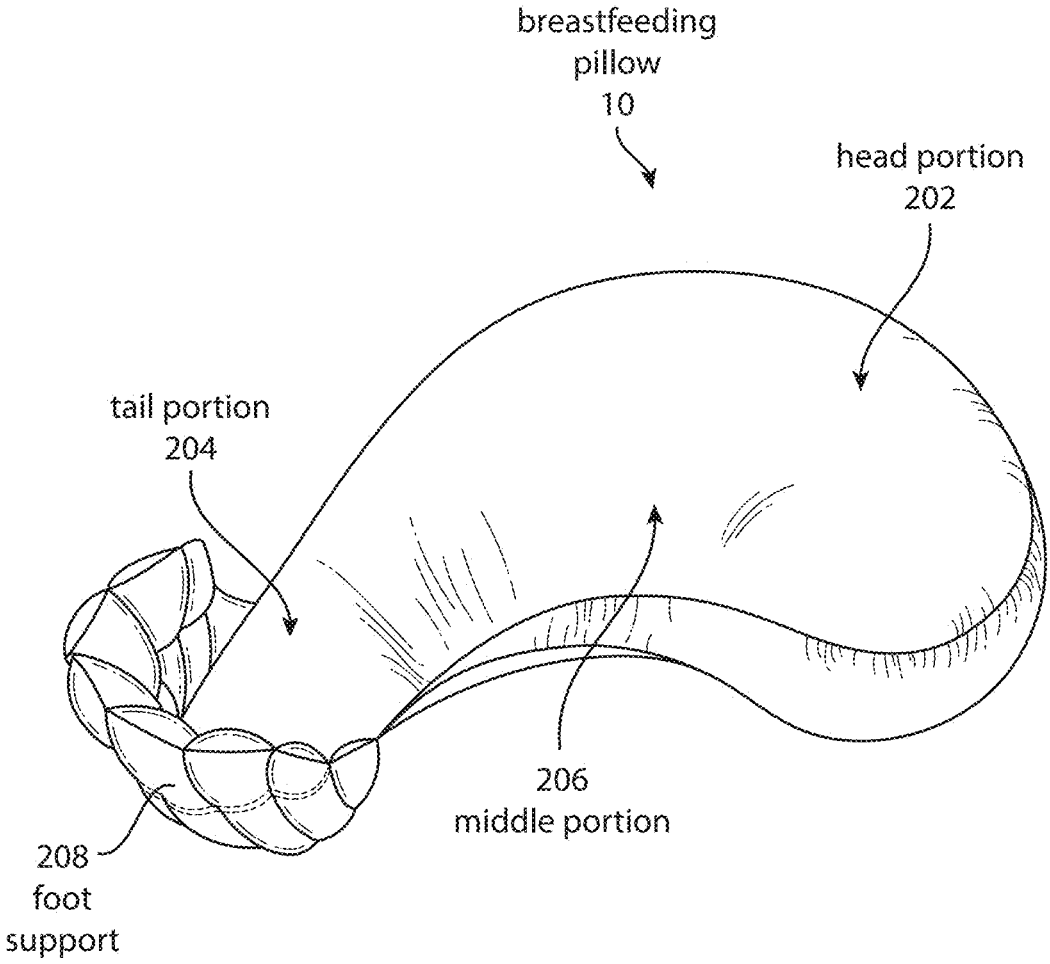
FIG. 2 illustrates a perspective view of the breastfeeding pillow, according to some embodiments.

FIG. 2 shows a perspective view of the pillow 10 including a head portion 202, a tail portion 204 located opposite the head portion 202, and a middle portion 206 located between the head portion 202 and the tail portion 204. In some embodiments, the pillow 10 includes a foot support 208 extending from the tail portion 204, as illustrated. The foot support 208 may be configured to extend substantially perpendicular to the tail portion 204 and may be configured to at least partially surround the end of the tail portion 204, as will be discussed further with reference to FIG. 6.

Figure 3:
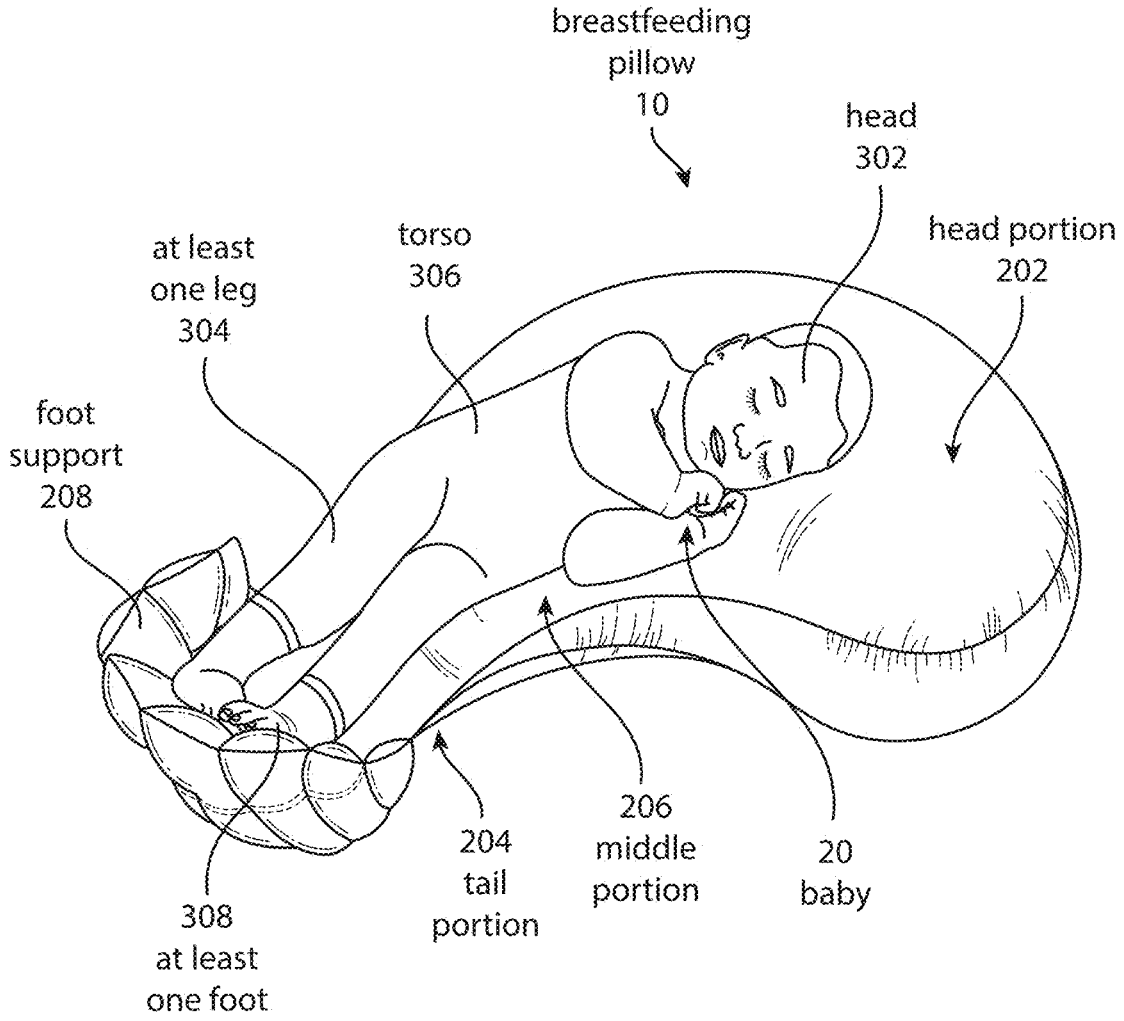
FIG. 3 illustrates a perspective view of a baby lying on the breastfeeding pillow, according to some embodiments.

Similar to FIG. 2, FIG. 3 shows a perspective view of the pillow 10 but includes the baby 20 lying on the pillow 10. As demonstrated in FIG. 3, the head portion 202 of the pillow 10 may be configured to support a head 302 of the baby 20, the tail portion 204 may be configured to support at least one leg 304 of the baby 20, and the middle portion 206 may be configured to support a torso 306 of the baby 20.

In some embodiments, the foot support 208 is configured to receive at least one foot 308 of the baby 20, such that the baby 20 may kick or press at least one foot 308 into and/or against the foot support 208. As discussed above, the bottom surface of the at least one foot 308 of the baby 20 includes pressure points that, when stimulated, help the baby 20 feel stable and secure. Including the foot support 208 on the pillow 10 provides the baby 20 with something to press against to stimulate those pressure points and increase the baby's 20 sense of comfort and safety while breastfeeding. In some embodiments, the foot support 208 is sufficiently stiff (i.e., not flimsy) to maintain its position despite pressure from the baby 20 kicking and/or pushing against the foot support 208. Stated another way, the foot support 208 may be firm enough to resist folding, collapsing, flopping, or other unintentional movement during, for example, nursing of the baby 20.

It should be noted that the pillow 10 may be sized and configured for use by newborns and young infants from birth to about six months of age. In some embodiments, the pillow 10 is sized and configured for use by infants from birth to about one year of age, or in some cases, from birth to about two years of age. Of course, the exact timeline of use will depend on the comfort and confidence of the nursing mother and the size of the baby, in addition to the baby's strength and case of breastfeeding. For example, a four-month-old infant may have an easy time nursing and may, by that age, be able to successfully nurse in a variety of positions without needing the specific support provided by the pillow 10. On the other hand, for example, a premature-born six-month-old infant may be smaller and/or not as strong and may need additional time to master breastfeeding in a highly supported environment, such as that provided by using the pillow 10. Exemplary dimensions of the pillow 10 will be provided later in this disclosure.

Figure 4A:
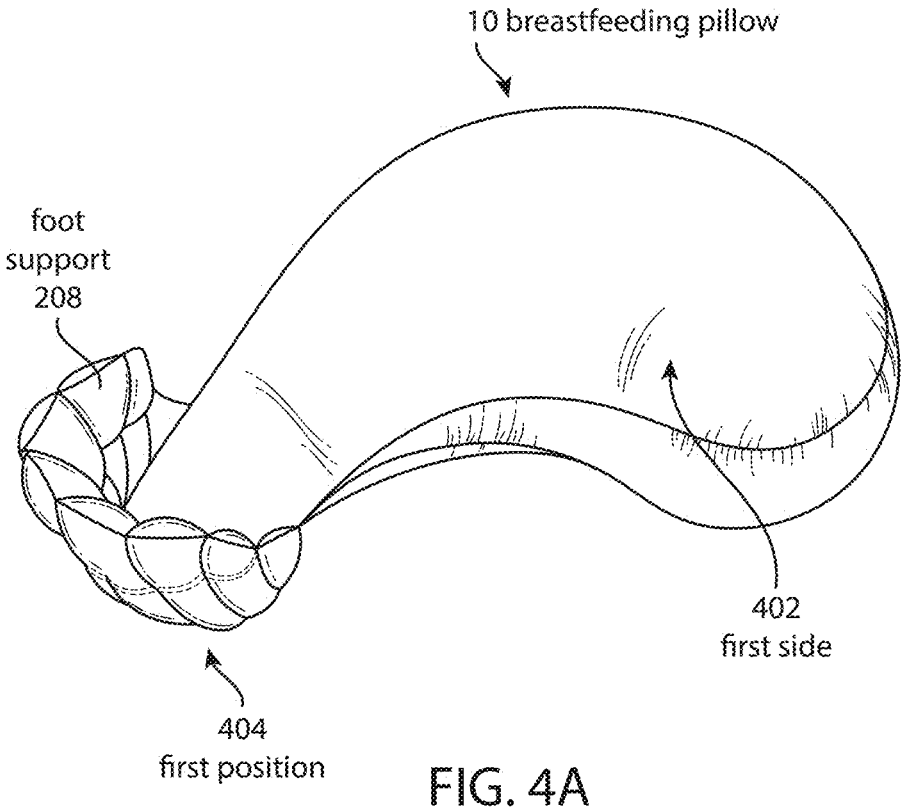
FIGS. 4A, 4B, 5A, and 5B illustrate perspective views of the breastfeeding pillow with the foot support in different positions, according to some embodiments.
Figure 4B:
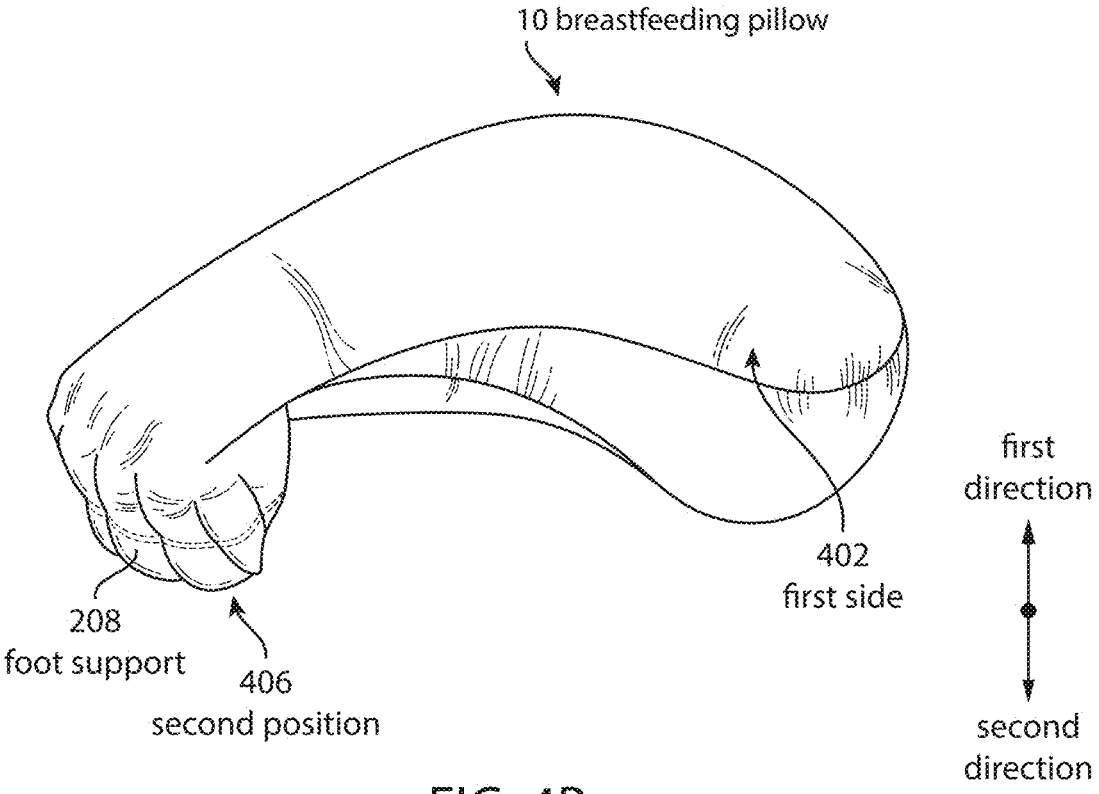
Figure 5A:
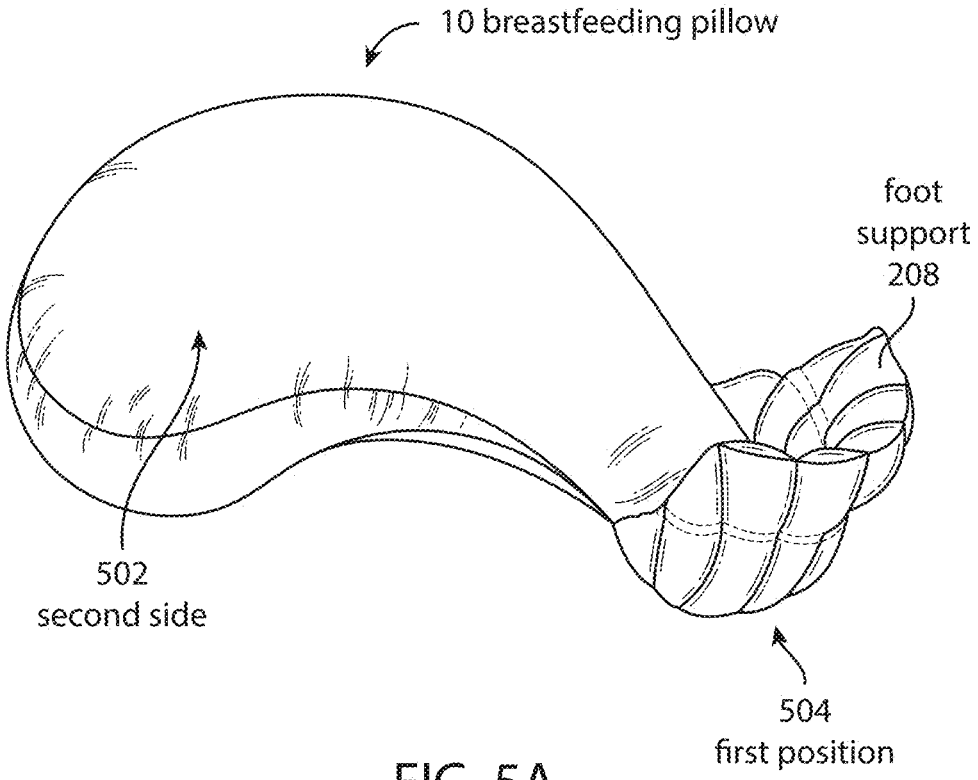
Figure 5B:
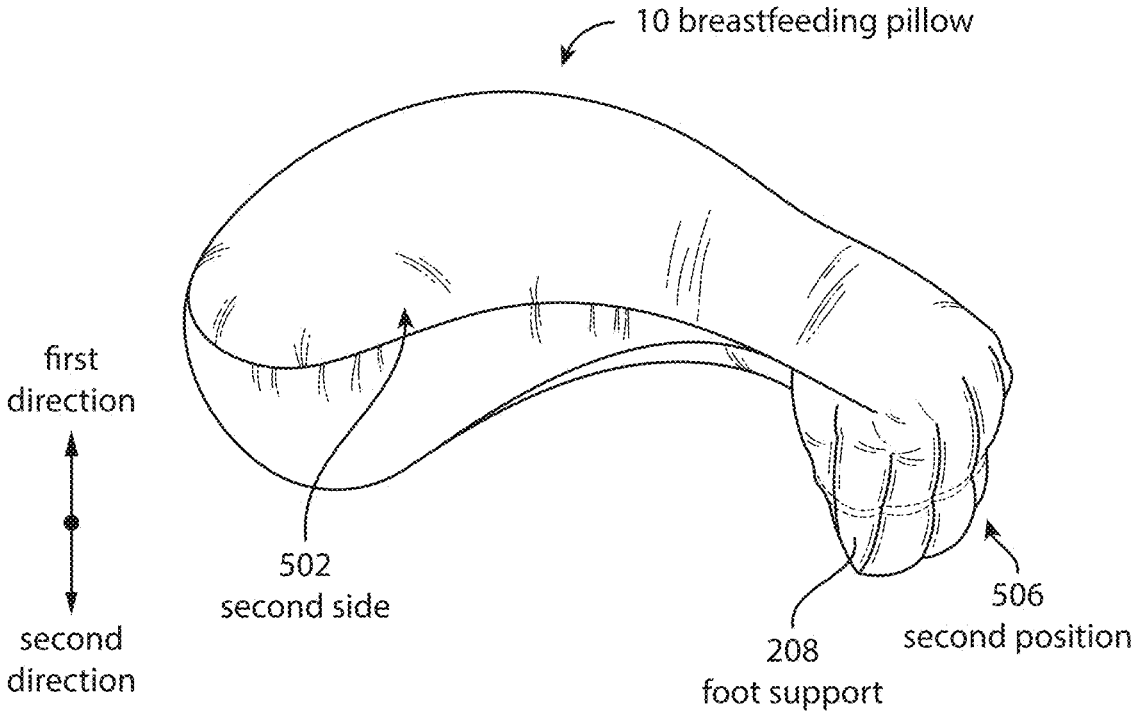

FIGS. 4A, 4B, 5A, and 5B again illustrate perspective views of the pillow 10. In some embodiments, the pillow 10 comprises a first side 402, as shown in FIGS. 4A and 4B, configured to align the baby 20 with a first breast of the nursing mother 30. The pillow 10 may also comprise a second side 502, as shown in FIGS. 5A and 5B, configured to align the baby 20 with a second breast of the nursing mother 30. Stated differently, the mother 30 may be able to flip the pillow 10 to accommodate nursing from either breast. For example, the first side 402 may be configured to align with the right breast of the mother 30, and the second side 502 may be configured to align with the left breast of the mother 30. In some embodiments, the second side 502 is located opposite the first side 402.

In some embodiments, the foot support 208 is configured to move between a first position 404, shown in FIG. 4A, and a second position 406, shown in FIG. 4B. In the first position 404, the foot support 208 may be configured to extend perpendicularly or substantially perpendicularly "upward" from the first side 402 of the pillow 10. The foot support 208 may also be described as extending along a first direction when in the first position 404, as indicated in FIG. 4A. The first position 404 may be ideal for use while breastfeeding when the baby 20 is lying on the first side 402, such as in the position shown in FIG. 3.

The second position 406 may be useful to move the foot support 208 out of the way while breastfeeding if the mother 30 does not want to use the foot support 208 while the baby 20 is lying on the first side 402. The second position 406 may be described as the foot support 208 extending perpendicularly or substantially perpendicularly "downward" from the first side 402. The foot support 208 may also be described as extending along a second direction when in the second position 406, as indicated in FIG. 4B. The second direction may be opposite the first direction. The second direction may also be opposite the first side 402. The first direction and the second direction may be substantially perpendicular to the tail portion 204. In some embodiments, the ability to move the foot support 208 between the first position 404 and the second position 406 facilitates the use of both the first side 402 and the second side 502 of the pillow 10.

FIGS. 5A and 5B are similar to FIGS. 4A and 4B, but show the second side 502 of the pillow 10, and illustrate the foot support 208 in the first position 504 and the second position 506 rather than the first position 404 and the second position 406. In some embodiments, in the first position 504, the foot support 208 is configured to extend perpendicularly or substantially perpendicularly "upward" from the second side 502, as shown in FIG. 5A. The foot support 208 may also be described as extending along a first direction when in the first position 504, as indicated in FIG. 5A. Accordingly, the first position 504 may represent the ideal positioning of the foot support 208 for breastfeeding with the baby 20 lying on the second side 502 of the pillow 10, assuming the baby 20 uses the foot support 208.

As discussed with reference to the second position 406, the second position 506 may be useful to move the foot support 208 out of the way while breastfeeding if the mother 30 does not want to use the foot support 208 while the baby 20 is lying on the second side 502. The second position 506 may be described as extending perpendicularly or substantially perpendicularly "downward" from the second side 502. The foot support 208 may also be described as extending along a second direction when in the second position 506, as indicated in FIG. 5B. The second direction may be opposite the first direction. The second direction may also be opposite the second side 502. In some embodiments, the first direction and the second direction are substantially perpendicular to the tail portion 204.

It should be noted that the first position 404 and the second position 506 may be substantially the same position. Further, the second position 406 and the first position 504 may be substantially the same position. This may be understood because the foot support 208 extending "upward" from the first side 402, as in the first position 404, is the same as the foot support 208 extending "downward" from the second side 502, as in the second position 506. Similarly, the foot support 208 extending "upward" from the second side 502, as in the first position 504, is the same as the foot support 208 extending "downward" from the first side 402, as in the second position 406. Accordingly, "flipping" the foot support 208 between the first position 404, 504 and the second position 406, 506 may accomplish moving the foot support 208 out of the way and/or preparing the pillow 10 for use on the other side.

It should also be noted that the foot support 208 may define substantially the same stiffness in the first position 404, 504 and the second position 406, 506. Stated differently, whether in the first position 404, 504 or the second position 406, 506, the foot support 208 may "feel" the same and may exhibit substantially equal ability to maintain its position despite pressure from the at least one foot 308 of the baby 20.

Figure 6:
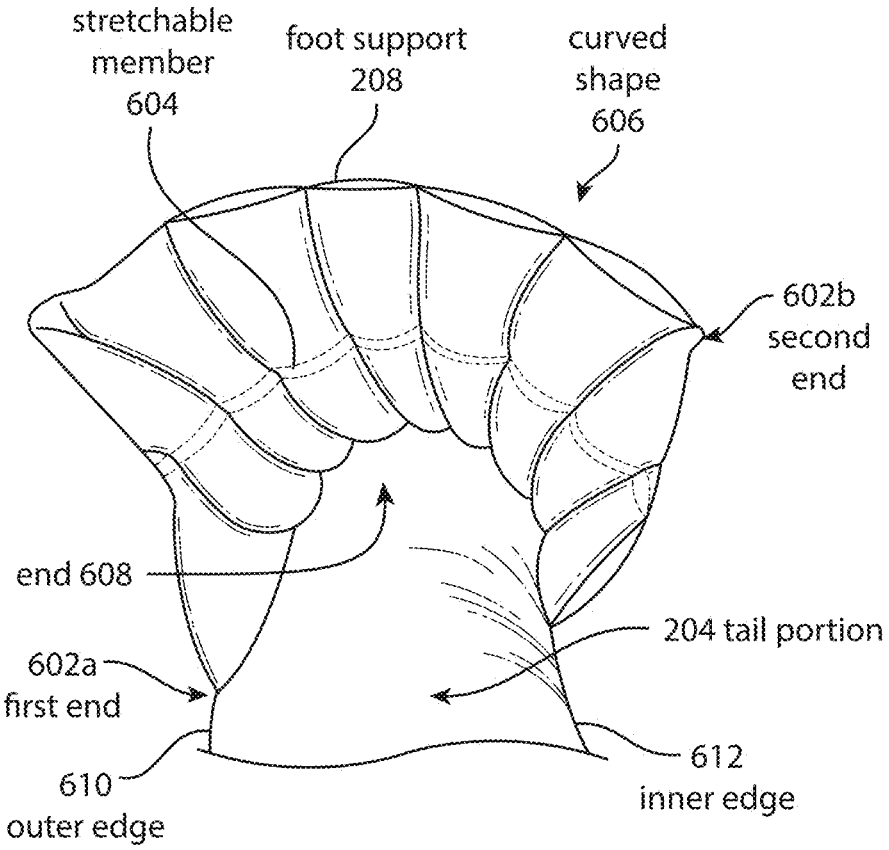
FIG. 6 illustrates a partial view of a tail portion of the breastfeeding pillow, according to some embodiments.

FIG. 6 shows a partial view of the pillow 10, including the tail portion 204 and the foot support 208. In some embodiments, the foot support 208 is coupled to an end 608 of the tail portion 204. In some embodiments, the tail portion 204 comprises the foot support 208 such that the foot support 208 may be considered an extension of the tail portion 204, rather than a separate element attached to the end 608 of the tail portion 204. In some embodiments, at least a portion of the foot support 208 is coupled to the tail portion 204 of the pillow 10. For example, at least a portion of the foot support 208 may be coupled to the tail portion 204 via stitching, while another portion of the foot support 208 extends from the tail portion 204 as a continuation of the tail portion 204.

The foot support 208 may be configured to at least partially surround the end 608 of the tail portion 204, as shown in FIG. 6. In some embodiments, the foot support 208 wraps around the end 608 of the tail portion 204 in an uneven manner such that the foot support 208 extends further along an outer edge 610 of the pillow 10 than an inner edge 612 of the pillow 10, as demonstrated in FIG. 6. This may enable greater physical contact between the baby 20 and the mother 30, as the inner edge 612 of the pillow 10 is the edge closest to the abdomen of the mother 30 during feeding. Accordingly, when the foot support 208 extends further along the outer edge 610, there is less room along the inner edge 612 for the foot support 208 to be located between the mother 30 and the baby 20, which may prevent or minimize skin-to-skin contact. In other embodiments, the foot support 208 may wrap around the tail portion 204 in an even manner such that the foot support 208 extends substantially equally along the outer edge 610 and the inner edge 612 of the pillow 10.

In some embodiments, the foot support 208 defines a first end 602*a* coupled to the tail portion 204 and a second end 602*b* located opposite the first end 602*a*, as indicated in FIG. 6. The first end 602*a* may be located adjacent to the tail portion 204. The foot support 208 may also include a stretchable member 604 located between the first end 602*a* and the second end 602*b*. In some embodiments, the stretchable member 604 extends substantially an entire length of the foot support 208. The stretchable member 604 may extend less than substantially an entire length of the foot support 208. In some embodiments, the stretchable member 604 is comprised of a flexible and elastic material located within an interior portion of the foot support 208. It should be noted that the stretchable member 604 is not limited to being comprised of "elastic" (the noun meaning "cord, tape, or fabric, woven with strips of rubber") material, but may be comprised of "elastic" (the adjective meaning "able to resume its normal shape spontaneously after contraction, dilatation, or distortion") material. The stretchable member 604 may include a continuous member (e.g., a continuous piece of material) or multiple members (e.g., multiple pieces of material).

In some embodiments, the stretchable member 604 is configured to maintain the curved shape 606 of the foot support 208, as illustrated in FIG. 6. The stretchable member 604 may maintain the curved shape 606 by providing tension along the length of the foot support 208. Further, the stretchable member 604 may provide structure to the foot support 208, which may help the foot support 208 remain upright when in the first position 404 or the first position 504 instead of simply "flopping" over under the force of gravity. The structure provided by the stretchable member 604 may also help the foot support 208 withstand pressure from the at least one foot 308 of the baby 20. In some embodiments, the stretchable nature of the stretchable member 604 enables the movement of the foot support 208 between the first position 404 and the second position 406, as shown in FIGS. 4A and 4B and, likewise, between the first position 504 and the second position 506, as shown in FIGS. 5A and 5B, respectively.

Figure 7:
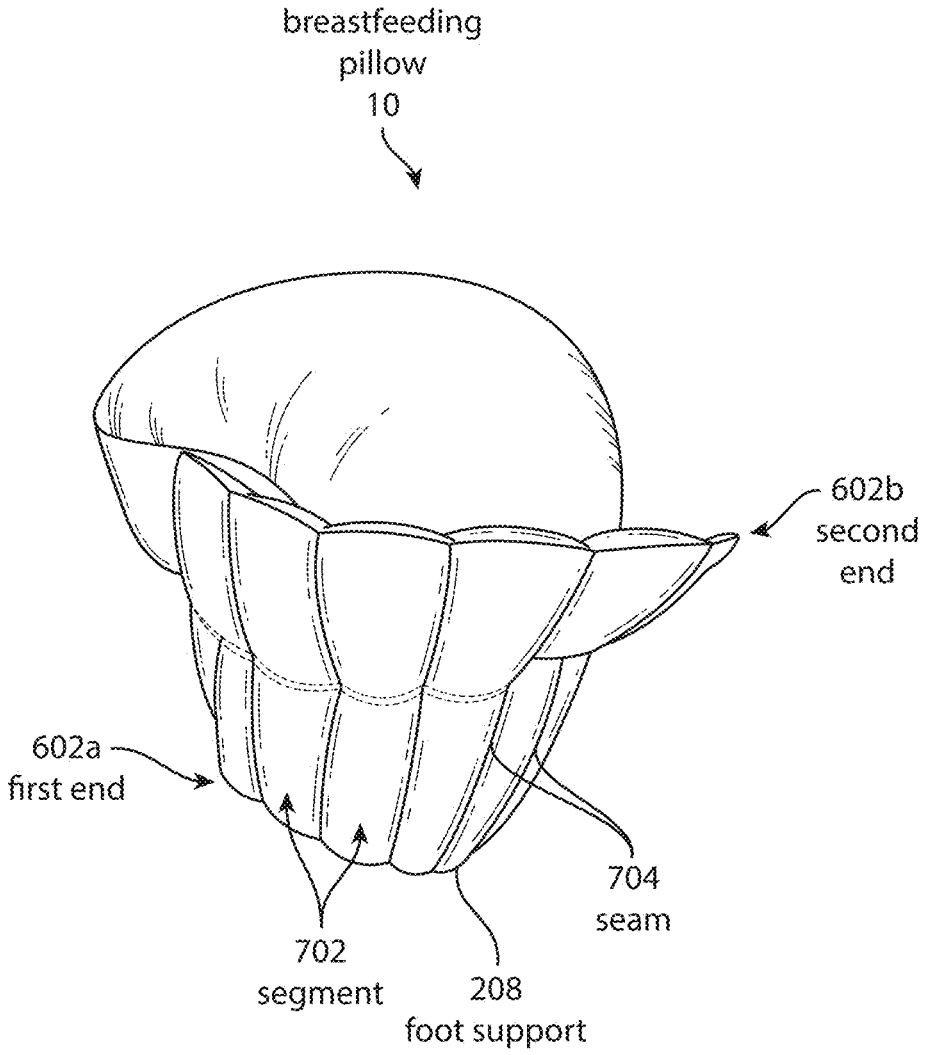
FIG. 7 illustrates an end view of the breastfeeding pillow, according to some embodiments.

In addition to the stretchable member 604, the structural integrity of the foot support 208 may be maintained by at least one segment 702 of the foot support, as shown in FIG. 7. In some embodiments, the foot support 208 includes multiple segments 702, which are formed by seams 704 sewn between the first end 602*a* and the second end 602*b* of the foot support 208. Each segment 702 may help keep the filler material of the foot support 208 in place, thereby helping the foot support 208 stay "stuffed" and maintaining the shape of the foot support 208. Keeping the foot support 208 filled may, in turn, preserve the stiffness of the foot support 208 and further prevent collapse or other unintentional movement of the foot support 208.

Figure 8:
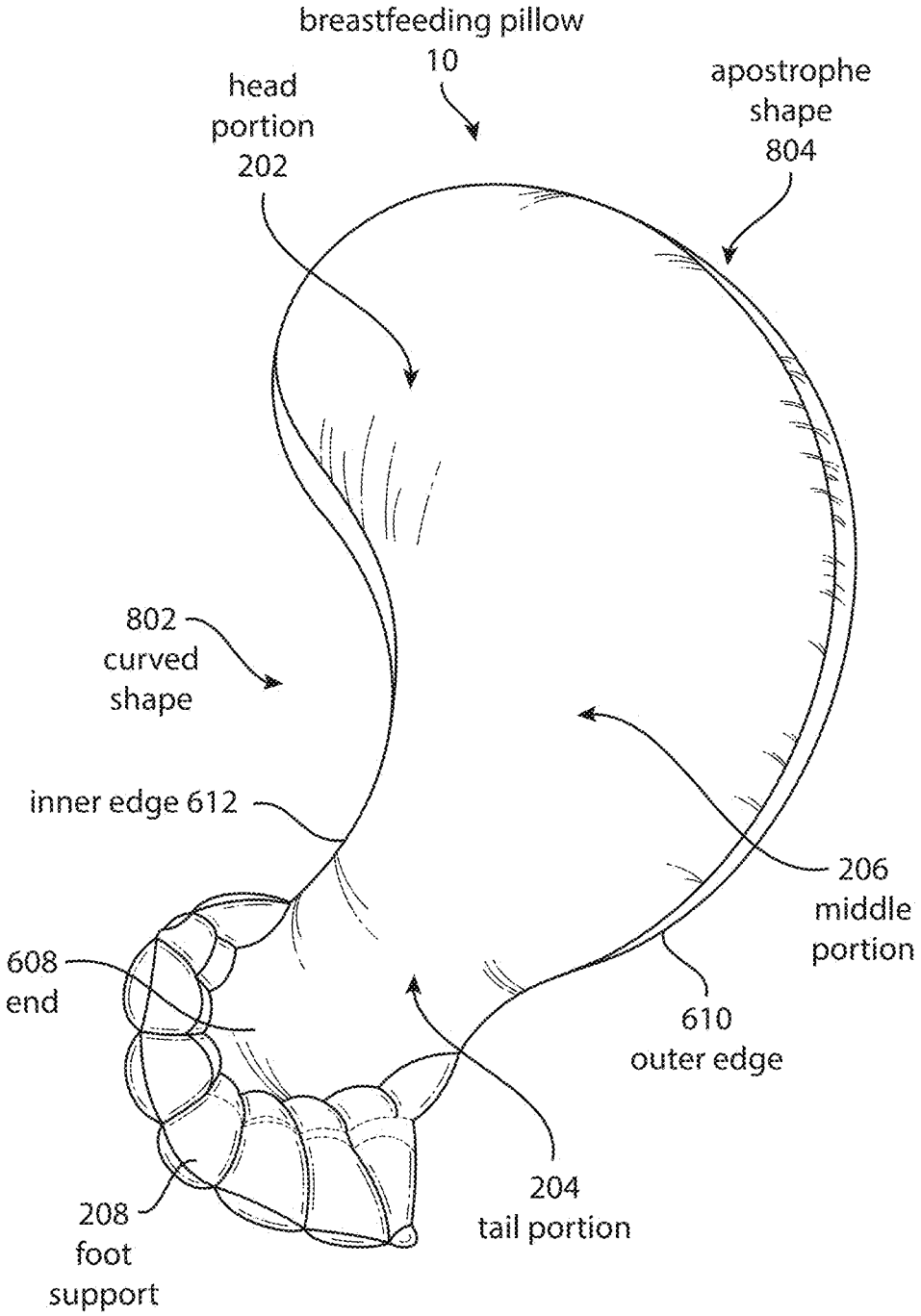
FIGS. 8 and 9 illustrate top views of the breastfeeding pillow, according to some embodiments.

FIG. 8 shows a top view of the pillow 10. In some embodiments, as discussed with reference to FIG. 6, the foot support 208 is configured to at least partially surround an end 608 of the tail portion 204. FIG. 8 also illustrates that the middle portion 206 of the pillow 10 may define a curved shape 802. In some embodiments, the head portion 202 and the tail portion 204 are asymmetrical with respect to the curved shape 802 of the middle portion 206. Stated differently, if the pillow 10 were reflected along an axis running substantially parallel with the length of the pillow 10 (see FIG. 9), the reflections on each side of that axis would be mirror images of one another, rather than being identical, as would be the case if the pillow 10 were symmetrical.

In some embodiments, the curved shape 802 is configured to fit around the abdomen of the nursing mother 30. The curved shape 802 may be configured to reduce the amount of space between the baby 20 and the mother 30 to thereby facilitate and promote physical contact between the baby 20 and the mother 30 while nursing. For example, the curved shape 802 may define a gentle curve rather than a more pronounced "C" shape to reduce the chance of a gap forming between the pillow 10 and the mother 30, into which the baby 20 could sink. In addition, the more open and gentle curve of the curved shape 802 may enable the pillow 10 to be used by mothers of different sizes, because the curved shape 802 is not as restrictive and enclosed as a more pronounced "C" shape pillow. In some embodiments, the curved shape 802 contributes to the overall apostrophe shape 804 of the pillow 10. Stated another way, the head portion 202, the tail portion 204, and the middle portion 206 may define the apostrophe shape 804. In some embodiments, the apostrophe shape 804 defines a substantially rounded apostrophe shape.

Figure 9:
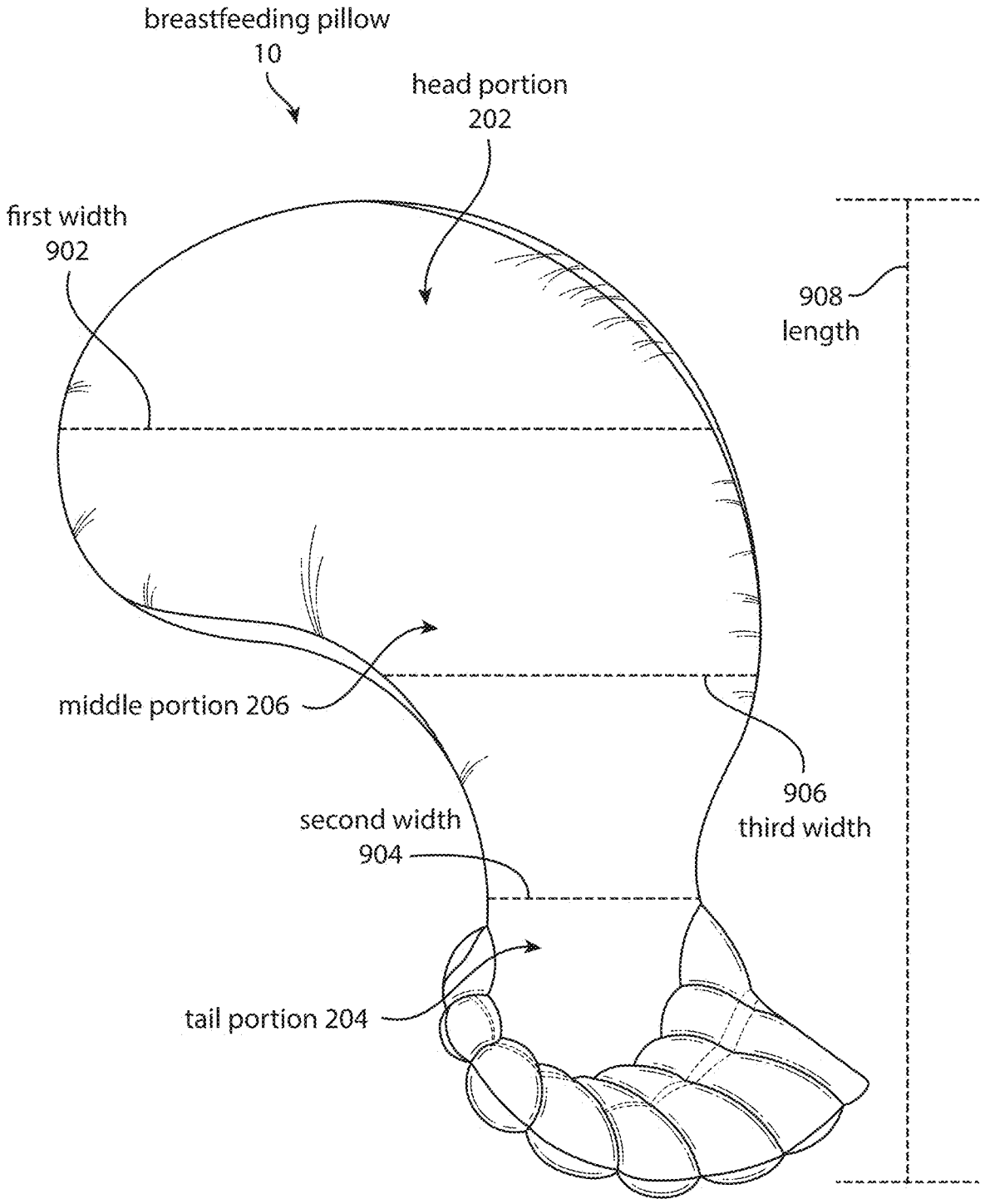

FIG. 9 illustrates another top view of the pillow 10 and indicates the different widths of different portions of the pillow 10, which may be attributed to the apostrophe shape 804. For example, in some embodiments, the head portion 202 defines a first width 902, and the tail portion 204 defines a second width 904 that is less than the first width 902. Further, the middle portion 206 may define a third width 906 less than the first width 902 but greater than the second width 904.

In some embodiments, the first width 902 is about 14 inches (about 35.5 centimeters), the second width 904 is about 7 inches (about 18 centimeters), and the third width 906 is about 10 inches (about 25.5 centimeters). FIG. 9 also indicates the length 908 of the pillow 10, which may be about 20 inches (about 51 centimeters). These values are intended as non-limiting examples, and the actual dimensions may be different than what is explicitly stated in this disclosure. For example, the width and/or length measurements of each of the first width 902, the second width 904, the third width 906, and the length 908 may independently range +/−about 5 inches (about 13 centimeters) from the stated dimensions.

Figure 10:
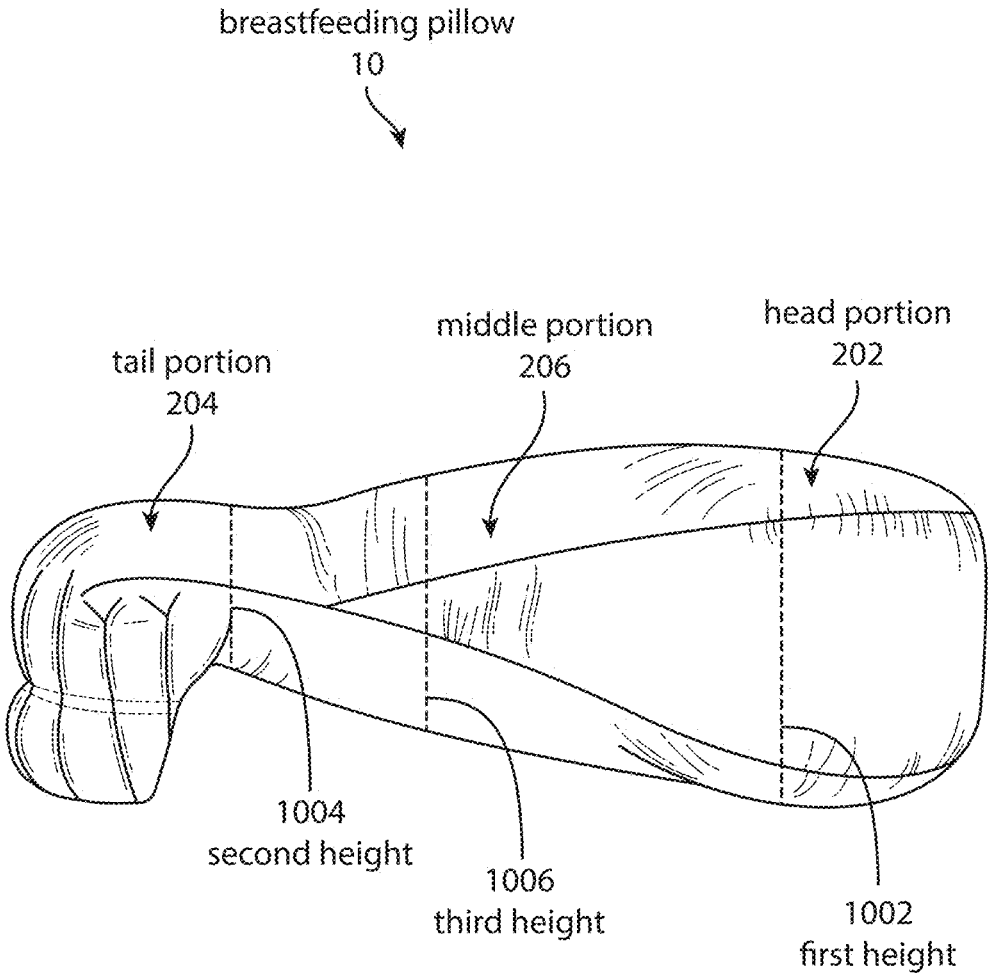
FIGS. 10 and 11 illustrate side views of the breastfeeding pillow, according to some embodiments.
Figure 11:
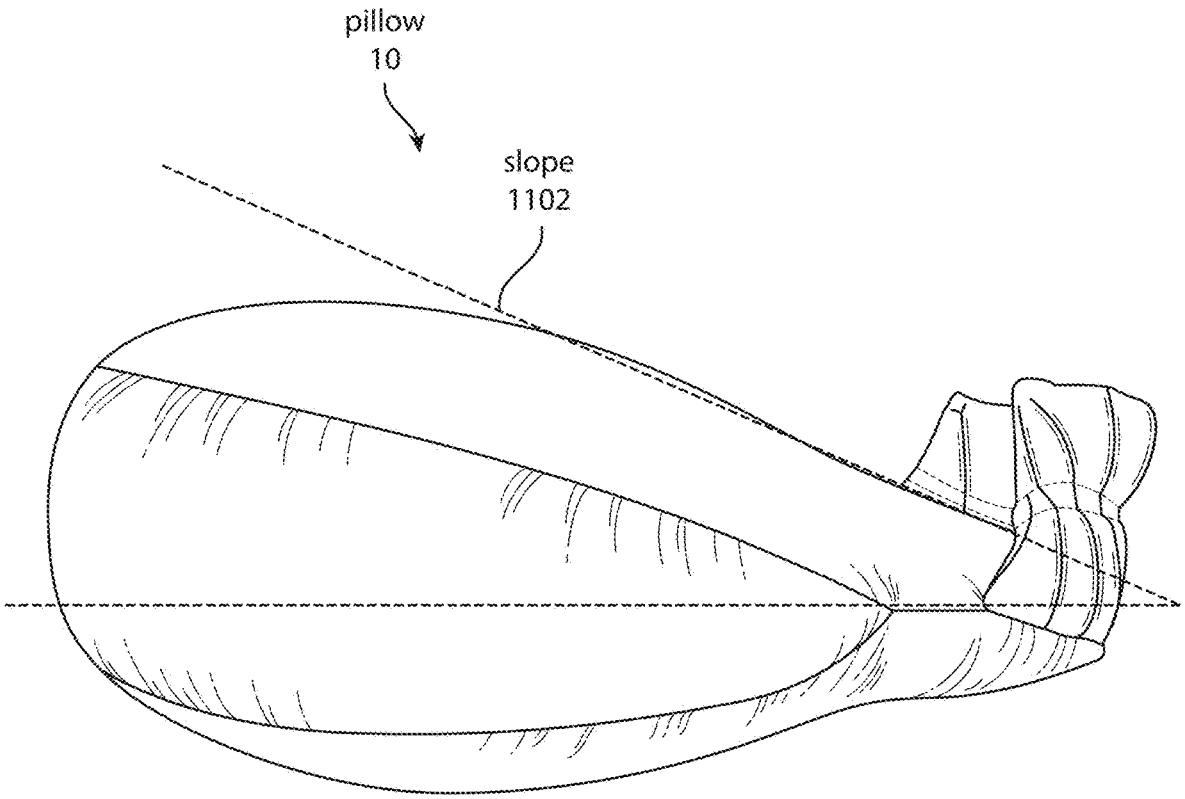

FIG. 10 shows a side view of the pillow 10 and indicates the different heights of different portions of the pillow 10. In some embodiments, the pillow 10 defines a tapered shape, as illustrated in FIG. 11, where the head portion 202 defines the greatest height and the tail portion 204 defines the lowest height. For example, as shown in FIG. 10, the head portion 202 may define a first height 1002, the tail portion 204 may define a second height 1004 that is less than the first height 1002, and the middle portion 206 may define a third height 1006 less than the first height 1002 but greater than the second height 1004.

In some embodiments, the first height 1002 is at least nine inches (about 23 centimeters), the second height 1004 is at least three inches (about 7.5 centimeters), and the third height 1006 is at least seven inches (about 18 centimeters). Further, the foot support 208 may define a height of about five inches (about 13 centimeters) and a length (i.e., distance curved around the tail portion 204) of about twelve inches (about 30.5 centimeters). These values are intended as non-limiting examples, and the actual dimensions may be different than what is explicitly stated in this disclosure. For example, the height and/or length measurements may range +/− about 3 inches (about 7.5 centimeters) from the stated dimensions.

In some embodiments, the pillow 10 is comprised of filler material, such as polyester fiberfill, foam padding, feathers, or the like encased in a fabric cover. Substantially the entirety of the pillow 10, including the head portion 202, the tail portion 204, the middle portion 206, and the foot support 208 may be comprised of the fabric cover with varying amounts of filler material. These varying amounts may contribute to the different heights identified in FIG. 10 and the slope 1102 illustrated in FIG. 11.

It should be noted that, in some embodiments, the pillow 10 is filled with an amount of filler material sufficient to support the baby 20, even though the filler is able to be compressed. Stated differently, the pillow 10 may be considered similar to an "overstuffed" cushion, with a large amount of filler material inside, giving the pillow 10 a generally rounded appearance that is substantially firm (e.g., not overly compressible) to the touch, while still being soft enough for the comfort of the baby 20 and the mother 30. The amount of filler material may be sufficient to maintain the head 302 of the baby 20 in a position substantially level with the mother's 30 breast, rather than sinking into the pillow 10. The varying amount of filler material in different portions of the pillow 10 may also be sufficient to maintain the angled position of the baby 20, as shown in FIG. 1.

FIG. 11 shows another side view of the pillow 10, and illustrates the slope 1102 of the pillow 10. As previously discussed, the pillow 10 may define an angled shape such that the pillow 10 is configured to elevate the head 302 of the baby 20 above the rest of the body. The elevated position of the head 302 may help facilitate swallowing by using gravity to move milk down the baby's 20 esophagus. In some embodiments, the slope 1102 is less than 45 degrees (wherein the slope is measured against a horizontal axis of the pillow, such as for example a horizontal centerline). For example, the slope 1102 may be between 25 and 35 degrees. The slope 1102 may be between 35 and 45 degrees. In some embodiments, the slope 1102 is less than 25 degrees. The slope 1102 may be any angle suitable to safely support the baby 20 while aiding with swallowing during feeding.

Figure 12:
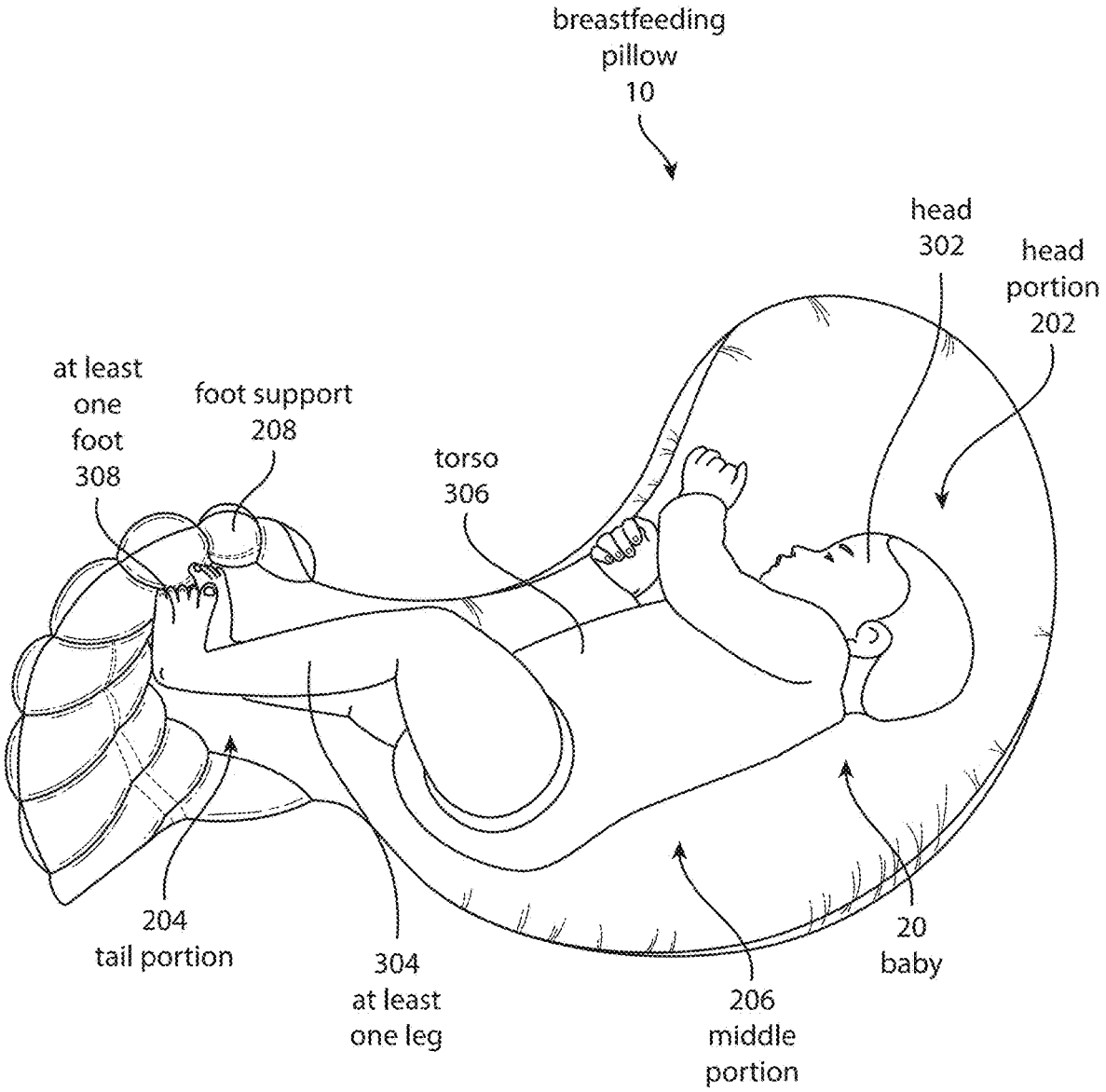
FIG. 12 illustrates a top view of a baby lying on the breastfeeding pillow, according to some embodiments.

FIG. 12 is similar to FIG. 3 but shows a top view, rather than a front perspective view, of the baby 20 lying on the pillow 10. In particular, FIG. 12 illustrates how the at least one foot 308 of the baby 20 fits into the pocket-like area created by the tail portion 204 and the foot support 208, to thereby press against the foot support 208. FIG. 12 also demonstrates the positioning of the baby 20 on the pillow 10, with the head 302 resting on the head portion 202, the torso 306 resting on the middle portion 206, and at least one leg 304 resting on the tail portion 204.

Figure 13:
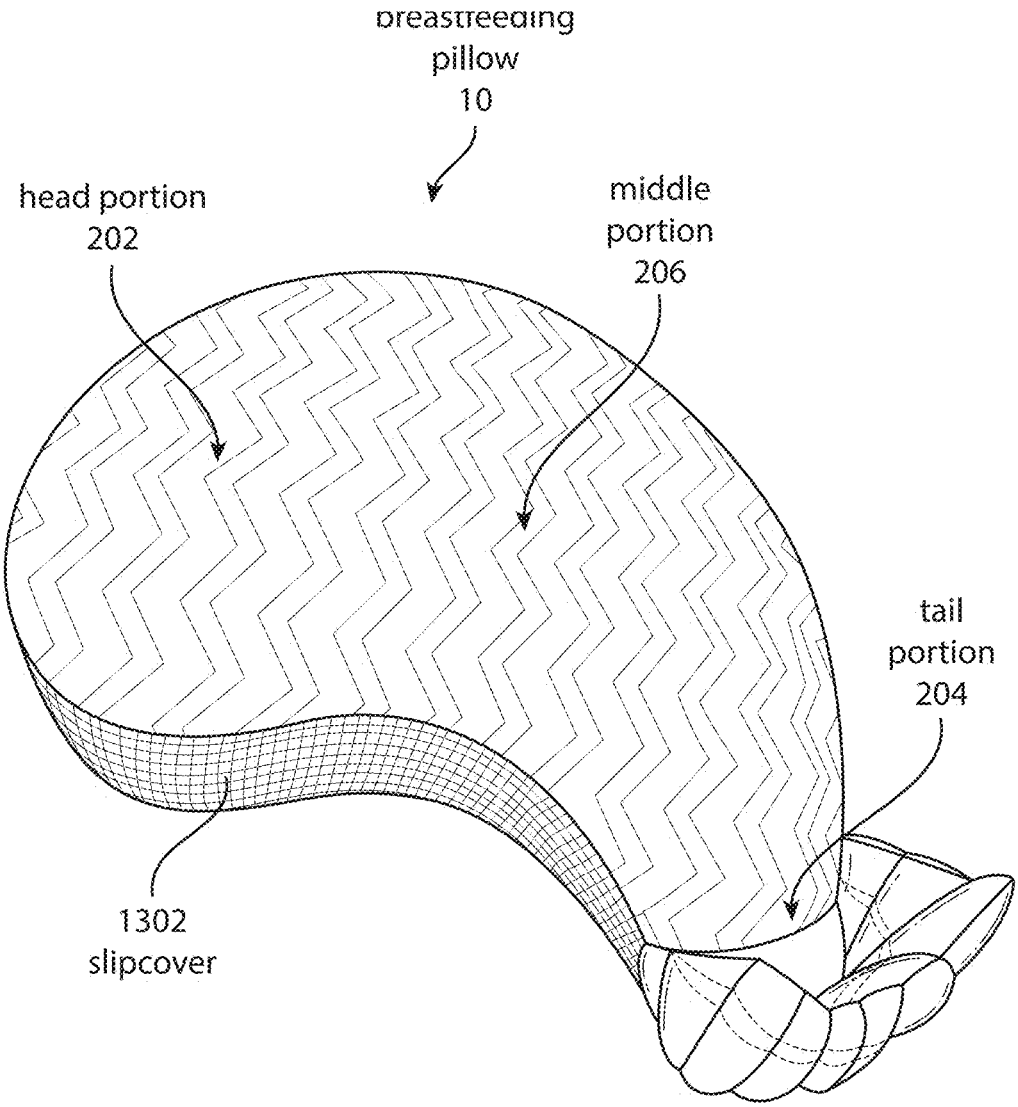
FIG. 13 illustrates a perspective view of the breastfeeding pillow inside the slipcover, according to some embodiments.
Figure 14:
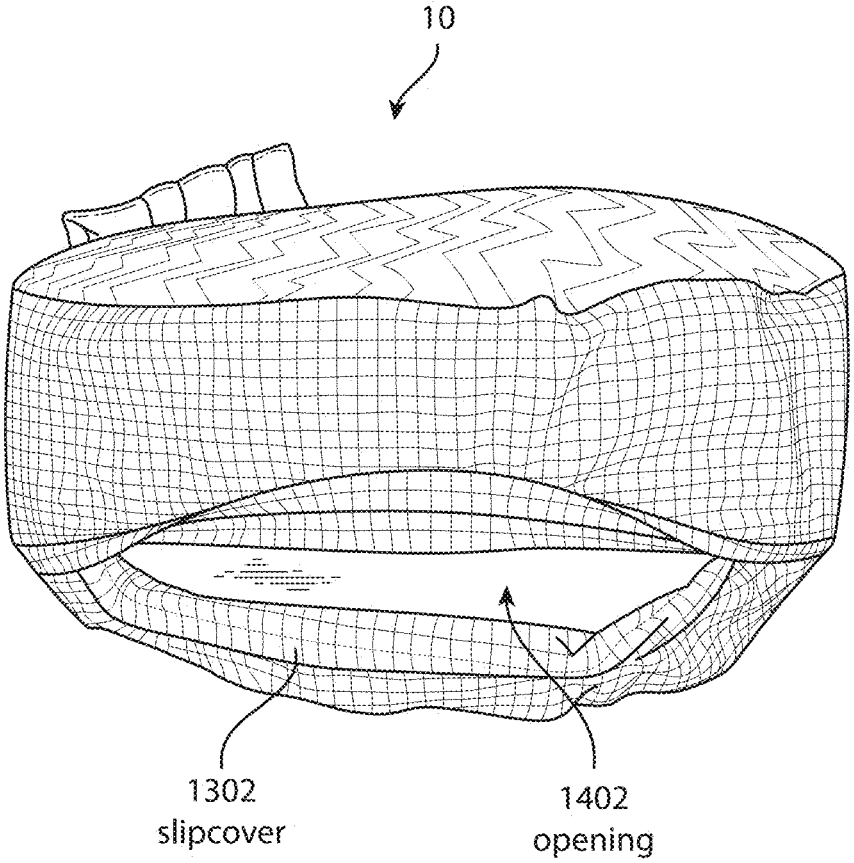
FIG. 14 illustrates an end view of the breastfeeding pillow inside a slipcover, according to some embodiments.

In some embodiments, the pillow 10 further comprises a slipcover 1302, as shown in FIGS. 13 and 14. The slipcover 1302 may be removably coupled to the pillow 10 via the opening 1402 illustrated in FIG. 14. In some embodiments, the slipcover 1302 includes a means for fastening, such as clastic or a similar stretchable material, used to keep the opening 1402 securely tight and closed over the pillow 10. The slipcover 1302 may include another fastening means such as, but not limited to, a zipper, at least one snap, at least one button, hook-and-loop fastener, and the like. The opening 1402 may be a simple opening without a fastener to secure it in a closed position, similar to a traditional pillowcase.

In some embodiments, the slipcover 1302 is configured to receive and retain each of the head portion 202, the middle portion 206, and at least a portion of the tail portion 204, as demonstrated in FIG. 13. In order to preserve the ability to move the foot support 208 between the first position 404, 504 and the second position 406, 506, the slipcover 1302 may not be configured to receive and retain the foot support 208. In some embodiments, the slipcover 1302 comprises a stretchable material, such as a knit fabric, configured to conform to the shape of the pillow 10, including the foot support 208. In such a case, the foot support 208 may be able to move between the first position 404, 504 and the second position 406, 506 while covered by the slipcover 1302.

Figure 15:
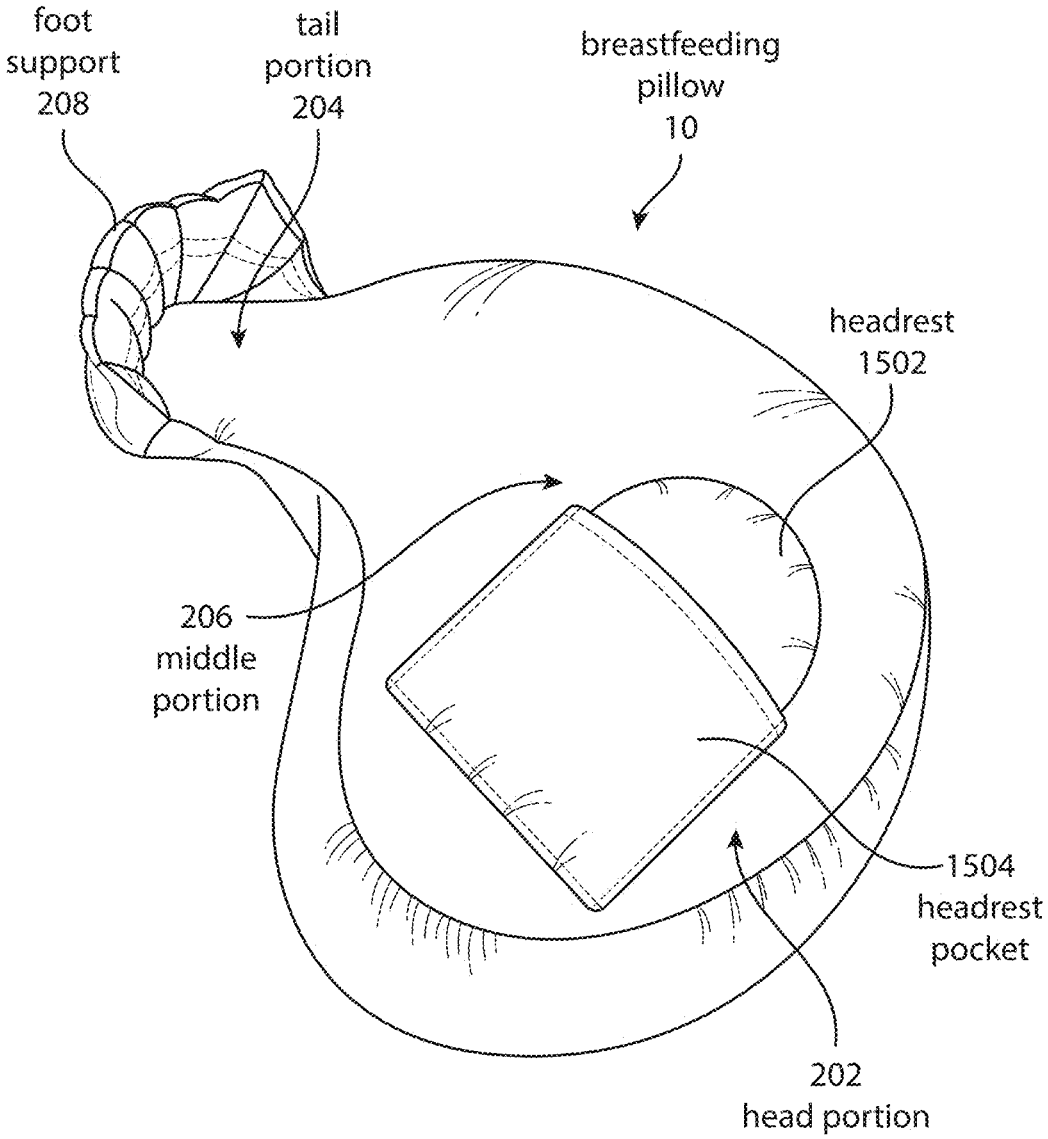
FIG. 15 illustrates a perspective view of the breastfeeding pillow including a headrest, according to some embodiments.

FIG. 15 illustrates a top perspective view of the pillow 10. In some embodiments, as shown in FIG. 15, the head portion 202 includes a headrest 1502. The headrest 1502 may be configured to further elevate the head 302 of the baby 20 above the surface of the pillow 10. The headrest 1502 may be integrated into the pillow 10, for example, located within an interior portion of the pillow 10. In some embodiments, the headrest 1502 is removably coupled to the pillow 10 via a headrest pocket 1504, as demonstrated in FIG. 15. FIG. 15 shows the headrest 1502 partially removed from the headrest pocket 1504, but it should be noted that during normal use, the headrest 1502 may be located substantially fully within the headrest pocket 1504.

The headrest pocket 1504 may be fixedly coupled (e.g., sewn) to the head portion 202 of the pillow 10. In some embodiments, the pillow 10 includes two headrest pockets 1504, one on the first side 402 and one on the second side 502. The headrest 1502 may comprise a small cushion configured to fit inside the headrest pocket 1504 (on either the first side 402 or the second side 502). Accordingly, the pillow 10 may include multiple headrest pockets 1504 and a single headrest 1502, as the headrest 1502 may only be used on one side of the pillow 10 at a time.

In some embodiments, the pillow 10 does not include the headrest pocket 1504, and the headrest 1502 is removably coupled to the pillow 10 with different means including, but not limited to, the following: hook-and-loop fastener, at least one snap fastener, at least one button, and combinations thereof. The headrest 1502 may be removably coupled so that the pillow 10 can be used without the headrest 1502. In some embodiments, the headrest 1502 is restably coupled to the pillow 10 without any fastening means.

The pillow 10 may be comprised of substantially natural materials, such as cotton, wool, linen, hemp, and the like. In some embodiments, the filler material comprises polyester, foam, or the like. The pillow 10 may be able to be washed in a standard laundry washing machine. In some embodiments, the pillow 10 includes a strap, buckle, or similar fastening element to secure the pillow 10 around the mother 30 to prevent movement of the pillow 10.

The disclosure includes a breastfeeding pillow including a head portion configured to support a head of a baby, a tail portion located opposite the head portion and configured to support at least one leg of the baby, and a middle portion located between the head portion and the tail portion, the middle portion configured to support a torso of the baby. In some embodiments, the breastfeeding pillow further comprises a foot support extending from an end of the tail portion, wherein the foot support is configured to receive at least one foot of the baby. The foot support may be configured to extend substantially perpendicular to the tail portion and may be configured to at least partially surround the end of the tail portion. In some embodiments, the foot support is configured to provide a surface for the at least one foot of the baby to press against, thereby providing pressure against the at least one foot of the baby.

The breastfeeding pillow may comprise a first side configured to align the baby with a first breast of a nursing mother and a second side configured to align the baby with a second breast of the nursing mother. In some embodiments, the foot support is configured to move between a first position and a second position, wherein in the first position, the foot support extends substantially perpendicular from the first side, and in the second position, the foot support extends substantially perpendicular from the second side.

The foot support may be configured to move between a first position and a second position, wherein in the first position the foot support extends along a first direction from the tail portion, and in the second position the foot support extends along a second direction from the tail portion, wherein the second direction is substantially opposite the first direction. The first direction and the second direction may extend substantially perpendicular from the tail portion.

In some embodiments, the foot support comprises a first end coupled to the tail portion and a second end located opposite the first end. The first end of the foot support may be configured to wrap around the tail portion. In some embodiments, the first end of the foot support wraps around the tail portion in an uneven manner such that the first end of the foot support extends further along an outer edge of the breastfeeding pillow than an inner edge of the breastfeeding pillow. The foot support may also include a stretchable member located between the first end and the second end, and the stretchable member may be configured to maintain a curved shape of the foot support.

The middle portion of the breastfeeding pillow may define a curved shape configured to fit around an abdomen of a nursing mother. In some embodiments, the curved shape reduces an amount of space between the baby and the nursing mother to thereby facilitate physical contact between the baby and the nursing mother. The head portion, the tail portion, and the middle portion may define an apostrophe shape.

In some embodiments, the head portion defines a first height and the tail portion defines a second height that is less than the first height, thereby configuring the breastfeeding pillow to elevate the head of the baby above the at least one leg of the baby. The middle portion may define a third height that is less than the first height and greater than the second height such that the breastfeeding pillow slopes downward from the head portion to the tail portion. In some embodiments, the first height is at least nine inches, the second height is at least three inches, and the third height is at least seven inches.

The foot support may define a height of about five inches and a length of about twelve inches. In some embodiments, the breastfeeding pillow defines an overall length of about twenty inches. The breastfeeding pillow may be sized and configured for use in feeding newborns and infants up to about six months of age.

In some embodiments, the breastfeeding pillow includes a removable slipcover configured to receive and retain each of the head portion, the middle portion, and at least a portion of the tail portion.

Some of the components listed herein use the same number from figure to figure. It should be appreciated these components use the same numbers solely for ease of reference and to facilitate comprehension for the reader. While these components may use the same numbers, differences may be present in these components as illustrated in the various figures in which they appear and as described in the specification herein.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

To increase the clarity of various features, other features are not labeled in each figure.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

The term "about" is used to mean "approximately." For example, the disclosure includes, "The foot support may define a height of about five inches . . . " In this context, "about five inches" is used to mean "approximately five inches." Any dimension between 2 and 8 inches may be understood as falling within the acceptable range of "about five inches," as defined in this disclosure.

The term "substantially" is used to mean "completely" or "nearly completely." For example, the disclosure includes, "The foot support may be configured to extend substantially perpendicular to the tail portion . . . " In this context, "substantially perpendicular" is used to mean "completely perpendicular" or "nearly completely perpendicular." The foot support is not required to extend at a perfect 90-degree angle to the tail portion to be understood as extending "substantially perpendicular." An angle between 80 and 100 degrees may be considered within the acceptable range of "substantially perpendicular," as defined in this disclosure.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

I claim:

1. A breastfeeding pillow, comprising:

a head portion configured to support a head of a baby;

a tail portion located opposite the head portion and configured to support at least one leg of the baby;

a middle portion located between the head portion and the tail portion, the middle portion configured to support a torso of the baby;

a first side configured to align the baby with a first breast of a nursing mother;

a second side configured to align the baby with a second breast of the nursing mother; and a foot support extending from an end of the tail portion, the foot support configured to receive at least one foot of the baby, wherein the foot support is configured to extend substantially perpendicular to the tail portion and is configured to at least partially surround the end of the tail portion, wherein the foot support is configured to provide a surface for the at least one foot of the baby to press against, thereby providing pressure against the at least one foot of the baby, and wherein the foot support is configured to move between a first position and a second position, wherein in the first position the foot support extends substantially perpendicular from the first side and in the second position the foot support extends substantially perpendicular from the second side.

2. The breastfeeding pillow of claim 1, wherein the foot support comprises a first end coupled to the tail portion and a second end located opposite the first end.

3. The breastfeeding pillow of claim 2, wherein the first end of the foot support is configured to wrap around the tail portion.

4. The breastfeeding pillow of claim 3, wherein the first end of the foot support wraps around the tail portion in an uneven manner such that the first end of the foot support extends further along an outer edge of the breastfeeding pillow than an inner edge of the breastfeeding pillow.

5. The breastfeeding pillow of claim 2, wherein the foot support comprises a stretchable member located between the first end and the second end, the stretchable member configured to maintain a curved shape of the foot support.

6. The breastfeeding pillow of claim 1, wherein the middle portion defines a curved shape configured to fit around an abdomen of a nursing mother and reduce an amount of space between the baby and the nursing mother to thereby facilitate physical contact between the baby and the nursing mother.

7. The breastfeeding pillow of claim 6, wherein the head portion, the tail portion, and the middle portion define an apostrophe shape.

8. The breastfeeding pillow of claim 1, wherein the head portion defines a first height and the tail portion defines a second height that is less than the first height, thereby configuring the breastfeeding pillow to elevate the head of the baby above the at least one leg of the baby.

9. The breastfeeding pillow of claim 8, wherein the middle portion defines a third height that is less than the first height and greater than the second height such that the breastfeeding pillow slopes downward from the head portion to the tail portion.

10. The breastfeeding pillow of claim 9, wherein the first height is at least nine inches, the second height is at least three inches, and the third height is at least seven inches.

11. The breastfeeding pillow of claim 1, wherein the foot support defines a height of about five inches and a length of about twelve inches.

12. The breastfeeding pillow of claim 1, wherein the breastfeeding pillow defines an overall length of about twenty inches.

13. The breastfeeding pillow of claim 1, wherein the breastfeeding pillow is sized and configured for use in feeding newborns and infants up to about six months of age.

14. The breastfeeding pillow of claim 1, further comprising a removable slipcover configured to receive and retain each of the head portion, the middle portion, and at least a portion of the tail portion.

15. A breastfeeding pillow, comprising:

a head portion configured to support a head of a baby;

a tail portion located opposite the head portion and configured to support at least one leg of the baby;

a middle portion located between the head portion and the tail portion, the middle portion configured to support a torso of the baby;

a first side configured to align the baby with a first breast of a nursing mother;

a second side configured to align the baby with a second breast of the nursing mother; and a foot support extending from an end of the tail portion, the foot support configured to receive at least one foot of the baby, wherein the foot support is configured to extend substantially perpendicular to the tail portion and is configured to at least partially surround the end of the tail portion, wherein the foot support is configured to provide a surface for the at least one foot of the baby to press against, thereby providing pressure against the at least one foot of the baby, and wherein the foot support is configured to move between a first position and a second position, wherein in the first position the foot support extends along a first direction from the tail portion, and in the second position the foot support extends along a second direction from the tail portion, wherein the second direction is substantially opposite the first direction.

16. The breastfeeding pillow of claim 15, wherein the first direction and the second direction extend substantially perpendicular from the tail portion.

17. The breastfeeding pillow of claim 15, wherein the foot support is configured to provide pressure against a bottom surface of the at least one foot of the baby, thereby stimulating at least one pressure point on the bottom surface of the at least one foot of the baby.

18. The breastfeeding pillow of claim 15, wherein the foot support comprises a plurality of segments extending from a first end of the foot support to a second end of the foot support, wherein the first end is coupled to the tail portion.

19. The breastfeeding pillow of claim 18, wherein each segment of the plurality of segments is filled with filler material.

20. The breastfeeding pillow of claim 19, wherein the plurality of segments is configured to maintain a shape and a stiffness of the foot support.

* * * * *